US006412650B1

(12) United States Patent
Warner

(10) Patent No.: US 6,412,650 B1
(45) Date of Patent: Jul. 2, 2002

(54) END CLOSURE MODULES FOR MULTI-CELL PRESSURE VESSELS, AND PRESSURE VESSELS AND VEHICLES CONTAINING THE SAME

(75) Inventor: Mark J. Warner, North Ogden, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/558,628

(22) Filed: Apr. 26, 2000

Related U.S. Application Data

(60) Provisional application No. 60/132,201, filed on May 3, 1999.

(51) Int. Cl.[7] ..... B65D 6/00

(52) U.S. Cl. ..... 220/4.12; 220/564; 220/581

(58) Field of Search ..... 220/564, 581, 220/4.12, 4.14, 507

(56) References Cited

U.S. PATENT DOCUMENTS

| | | | | |
|---|---|---|---|---|
| 2,106,494 A | | 1/1938 | Debor | |
| 2,148,234 A | | 2/1939 | Debor | |
| 2,171,972 A | * | 9/1939 | Debor | 220/584 |
| 2,171,973 A | | 9/1939 | Debor | |
| 2,341,044 A | | 2/1944 | Jackson et al. | |
| 2,408,105 A | | 9/1946 | Starret | |
| 2,457,118 A | | 12/1948 | Boardman | |
| 3,414,153 A | * | 12/1968 | Leroux | 220/565 |
| 3,608,767 A | * | 9/1971 | Elliot et al. | 220/4.12 |
| 3,645,415 A | * | 2/1972 | Phelps | 220/565 |
| 4,182,254 A | * | 1/1980 | Secord | 114/74 A |
| 4,615,452 A | | 10/1986 | Lederer et al. | |
| 4,946,056 A | | 8/1990 | Stannard | |
| 5,577,630 A | | 11/1996 | Blair et al. | |
| 5,787,920 A | | 8/1998 | Krasnov | 137/255 |
| 5,931,335 A | * | 8/1999 | Cippitani | 220/724 |

FOREIGN PATENT DOCUMENTS

| | | |
|---|---|---|
| DE | 3225930 A1 | 1/1984 |
| WO | WO 98/09876 | 3/1998 |

* cited by examiner

*Primary Examiner*—Mickey Yu
*Assistant Examiner*—Troy Arnold
(74) *Attorney, Agent, or Firm*—Sullivan Law Group

(57) ABSTRACT

Closure modules are coupled to and enclose ends of a multi-cell pressure vessel, especially a multi-cell pressure vessel having arcuate outer wall segments connected by internal web segments that define a plurality of cells in the pressure vessel. The closure modules each have an arcuate surface portion and at least one interfacing surface portion integrally connected at a marginal extent thereof with a marginal extent of the arcuate surface portion. The arcuate surface and interfacing surface portions define a closure module chamber and have peripheral edges. The arcuate surface portion of one of the closure modules abuts contiguously against an interfacing surface portion of an adjacent one of the closure modules. The closure modules are particularly useful for use with multi-cell tanks and vessel bodies, especially tanks and vessels suitable for storing liquid propane.

26 Claims, 8 Drawing Sheets

END CLOSURE MODULES FOR MULTI-CELL PRESSURE VESSELS, AND PRESSURE VESSELS AND VEHICLES CONTAINING THE SAME

RELATED APPLICATIONS

Priority is claimed of provisional application No. 60/132,201 filed in the U.S. Patent & Trademark Office on May 3, 1999, the complete disclosure of which is incorporated herein by reference.

BACKGROUND OF THE INVENTION

1. Field of the Invention

This invention relates to the structure and fabrication of end closure modules for coupling to and enclosure of tanks and vessel bodies. More particularly, this invention relates to end closure modules for coupling to and enclosure of multi-cell tanks and vessel bodies, especially tanks and vessels suitable for storing liquid propane.

2. Description of the Related Art

Pressure vessels are widely known for storing liquids and gases under pressure. One growing application of pressure vessels is their use in the storage of alternative fuels, such as propane and natural gas, for use in vehicles such as automobiles. Alternative fuels are increasingly being viewed as preferable to gasoline for fueling vehicles. Accordingly, approaches have been devised for converting gasoline-fueled vehicles to propane-fueled vehicles by retrofitting the gasoline-fueled vehicles to use propane (or natural gas) instead of gasoline. Vehicles are currently being built which are designed to operate using propane (or natural gas) as their fuel source.

Typical storage tanks are cylindrical in shape. Positioning cylindrical storage tanks in the envelope utilized for a fuel tank in most vehicles results in substantial limitations in the amount of propane or natural gas a vehicle can carry. Hence, storage tanks have been devised which utilize a plurality of arcuate outer wall segments that are connected by internal web segments to form a multi-cell pressure vessel. Such multi-cell pressure vessels have a generally uniform cross section, thereby enabling the outer wall segments to be formed by extrusion.

A multi-cell pressure vessel body especially advantageous for storage of compressed natural gas or liquid propane disclosed in PCT US97/15116 (WO 98/09876), the complete disclosure of which is incorporated by reference. This preferred vessel body structure is depicted in FIGS. 4–7 herein and discussed in greater detail below.

One disadvantage associated with multi-cell pressure vessels is the difficulty of obtaining a secure and inexpensive joint for connecting end closures to the body structure of the pressure vessel. Conventionally, dome closures of multi-cell pressure vessels have been constructed as depicted in FIG. 8. Referring to FIG. 8, dome segments 802 are fabricated from standard stamped or spun material, with the dome segments 802 being coupled together at mating joints. Internal reinforcement ribs 804 are provided at the joints of the dome sections to carry internal pressures. Typically, the dome segments 802 are coupled together and to the internal reinforcement ribs 804 by welding. This technique permits for a variety of dome structures to be fabricated; however, the use of welded joints and separate dome segments 802 and ribs 804 increases manufacturing costs and time.

One-piece domes partially eliminate the problems associated with welding dome segments to each other and to internal reinforcement ribs. An example of a one-piece dome having reinforcing ribs is illustrated in FIG. 9 and designated by reference numeral 900. However, expensive tooling is required to stamp one-piece domes. Further, conventional tooling for stamping one-piece domes is capable of forming domes for only one tank size. Thus, different stamp toolings must be provided for making tanks of different sizes and shapes. Additionally, the one-piece dome embodiment still requires the manual welding of reinforcement ribs 904 inside the dome for imparting reinforcing strength.

It would, therefore, be a significant advancement in the art to provide a set of end dome structures for a multi-cell vessel that would be inexpensive to manufacture and assemble in a variety of arrangements, yet is not prone to significant losses in strength such as those which arise from exposure to heat during conventional welding techniques.

SUMMARY OF THE INVENTION

It is, therefore, an object of this invention to provide a set of closure modules of an end closure structure for a multi-cell pressure vessel that attains the above-discussed advancement in the art.

Generally, the body portion of a multi-cell pressure vessel comprises a plurality of arcuate outer wall segments connected by internal web segments. Most, if not all of the cells are individually defined by a combination of at least one internal web segment and at least one arcuate outer wall segment. Optionally, for cases in which the body portion is defined by more than two rows and more than two columns of cells, some of the internal cells of the multi-cell pressure vessel can be individually defined by a combination of internal web segments, but not arcuate outer wall segments.

Each of the cells defines a cell chamber and terminates at opposite ends thereof to define respective cell chamber openings. Each of the cell chamber openings is thereby defined at a periphery thereof by edges of either a combination of at least one internal web segment and at least one arcuate outer wall segment or, for internal cells defined by internal web segment but not arcuate outer wall segments, a combination of internal web segments.

A first end closure module and a second end closure module each comprises an arcuate surface portion and at least one interfacing surface portion. The interfacing surface portion has a marginal extent integrally connected with a marginal extent of the arcuate surface portion. The inner surfaces of the arcuate surface portion and the interfacing surface portion, collectively or in combination with at least one additional interfacing surface portion of the end closure modules, define a closure module chamber associated with a closure module opening. The closure module opening is defined at a periphery thereof by free edges of the arcuate surface portion and the interfacing surface portion or free edges of the arcuate surface portion, the interfacing surface portion, and the additional interfacing surface portion. For modules associated with internal cells defined by internal web segments but not arcuate outer wall segments, however, the closure module opening is defined at its periphery by a combination of interfacing surface portions. In the preferred embodiment illustrated in the drawings, the interfacing surface portions are planar.

Optionally, joggles or rims can be formed about respective closure module openings and constructed and arranged to be inserted into and coupled to ends of associated cells, so that the closure modules cooperate with their associated cells to close the ends of the associated cell chambers. The interfacing surface portion of the first closure module is constructed and arranged to lie contiguously against the interfacing surface of the adjacent second closure module, thereby facilitating the coupling of the adjacent first and second closure modules to each other. The respective interfacing surface portions of the adjacent first and second closure modules can be coupled by coupling the set of closure modules to ends of their respective associated cells. Additionally or in the alternative, the interfacing surfaces of the adjacent first and second closure modules can be welded, brazed, fastened or otherwise coupled together.

It is another object of this invention to provide a multi-cell pressure vessel comprising a multi-cell vessel body and one or more of the above-discussed sets of closure modules. The multi-cell pressure vessel of this invention can be installed (as original or retrofitted parts) by techniques known to those of ordinary skill in the art in various kinds of vehicles, including, by way of example, cars, trucks, vans, sport utility vehicles, military vehicles, recreational vehicles, aircraft, and boats and ships.

According to an aspect of the invention, the multi-cell pressure vessel comprises a body portion comprising a plurality of arcuate outer wall segments connected by internal web segments that collectively define a plurality of cells and terminate at ends thereof to define peripheries of cell chamber openings. The vessel also comprises a set of closure modules, with each closure module of the set of closure modules closing an associated end of a respective one of the cells at a respective one of the cell chamber openings. The set of closure modules includes a first closure module and a second closure module. Each of the first and second closure modules comprises, respectively, an arcuate surface portion having an inner surface and an interfacing surface portion having an inner surface, an outer surface opposite to the inner surface, and a marginal extent. The inner and outer surfaces are preferably planar. The marginal extent of the interfacing surface portion is integrally connected with a marginal extent of the arcuate surface portion. The inner surface of the arcuate surface portion and the planar inner surface of the interfacing surface portion define, collectively or in combination with at least one additional interfacing surface portion, a closure module chamber with a closure module opening. The closure module opening is defined at a periphery thereof by either free edges of the arcuate surface portion and the interfacing surface portion or free edges of the arcuate surface portion, the interfacing surface portion, and the at least one additional interfacing surface portion. The planar outer surface of the interfacing surface portion of the first closure module abuts contiguously against and is coupled with the planar outer surface of the interfacing surface portion of the second closure module. Preferably, these abutting interfacing surface portions are oriented parallel to the internal web segments.

Other objects, aspects and advantages of the invention will be apparent to those skilled in the art upon reading the specification and appended claims which, when read in conjunction with the accompanying drawings, explain the principles of this invention.

BRIEF DESCRIPTION OF THE DRAWINGS

The accompanying drawings serve to elucidate the principles of this invention. In such drawings.

DETAILED DESCRIPTION OF THE INVENTION

Figure 1:
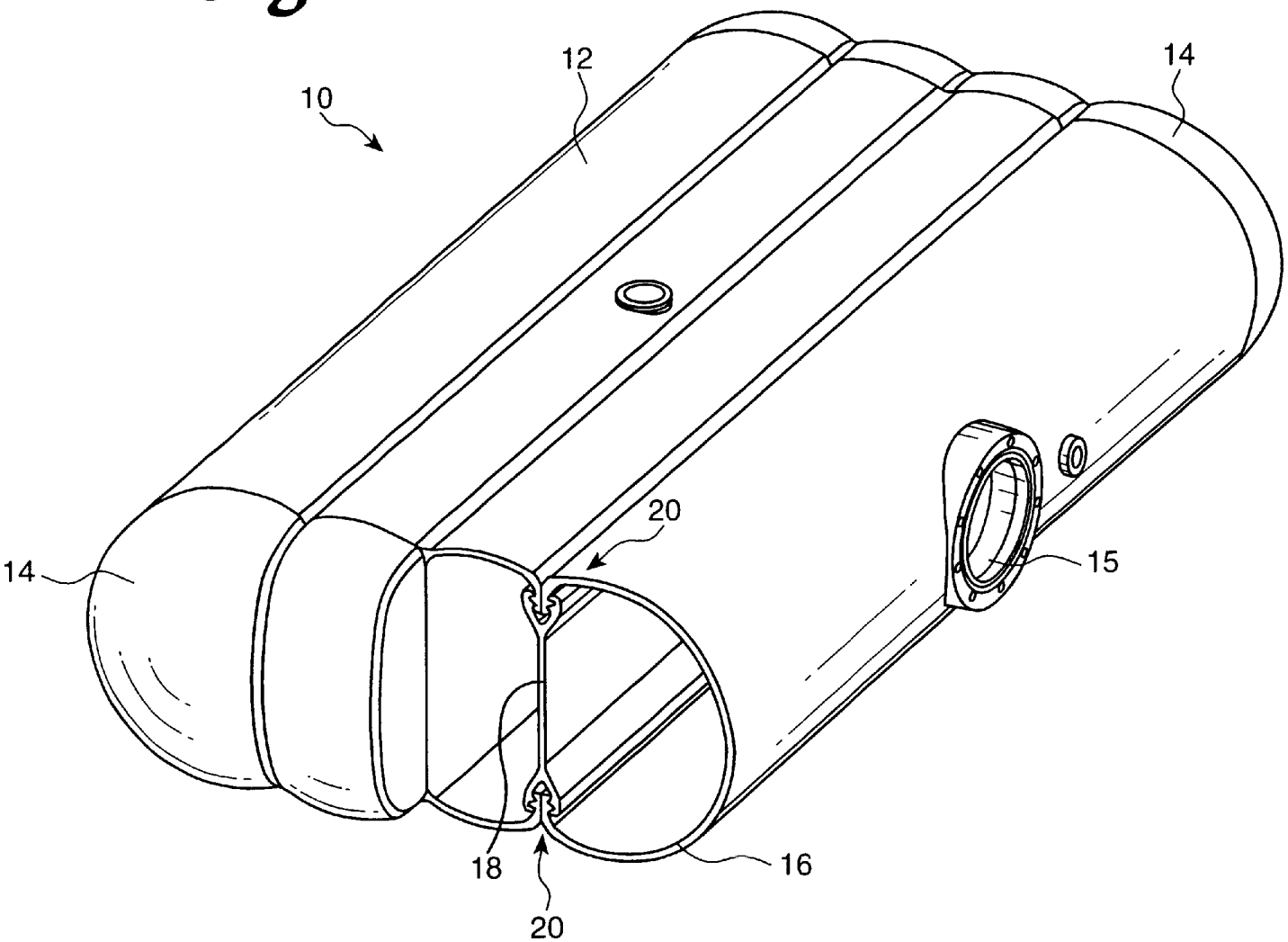
FIG. 1 is a perspective view of a pressure vessel of this invention with portions cut away to illustrate a joint.

Referring now more particularly to FIG. 1, one embodiment of a multi-cell pressure vessel of the present invention is designated generally by reference numeral 10. The pressure vessel 10 includes a multi-cell vessel body (or body portion) 12 and sets of closure modules 14. The body portion 12 is preferably of a substantially uniform cross section, and has access port 15.

The body portion 12 may be configured according to any design known to one of skill in the art. In accordance with a preferred embodiment of this invention, the body portion 12 generally comprises a plurality of arcuate outer wall segments 16. The outer wall segments 16 are connected with internal web segments 18. In the illustrated embodiment, the cells are individually defined by a combination of at least one internal web segment and at least one arcuate outer wall segment. As understood in the art, the internal web segments 18 can have passages (not shown) formed therethrough for placing the cells in fluid communication. Although not shown in FIG. 1, for a pressure vessel defined by more than two rows and more than two columns of cells, one or more of the internal cells of the multi-cell pressure vessel can be individually defined by a combination of internal web segments, but not any arcuate outer wall segments.

Suitable joints 20 for connecting the outer wall segments 16 together and to the internal web segments 18 are described below in greater detail.

Figure 2A:
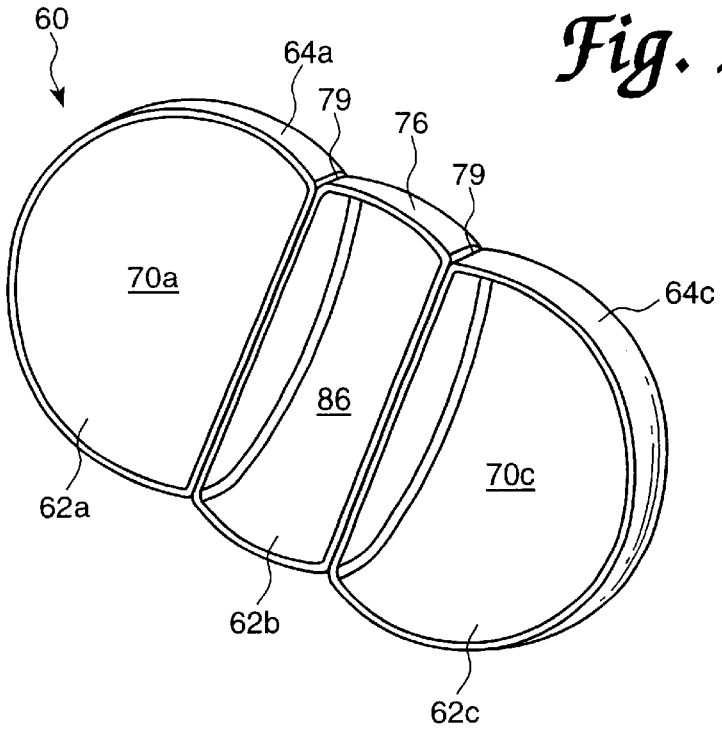
FIGS. 2A and 2B perspective view and a perspective exploded view, respectively, of a set of closure modules arranged in accordance with an embodiment of this invention.
Figure 2B:
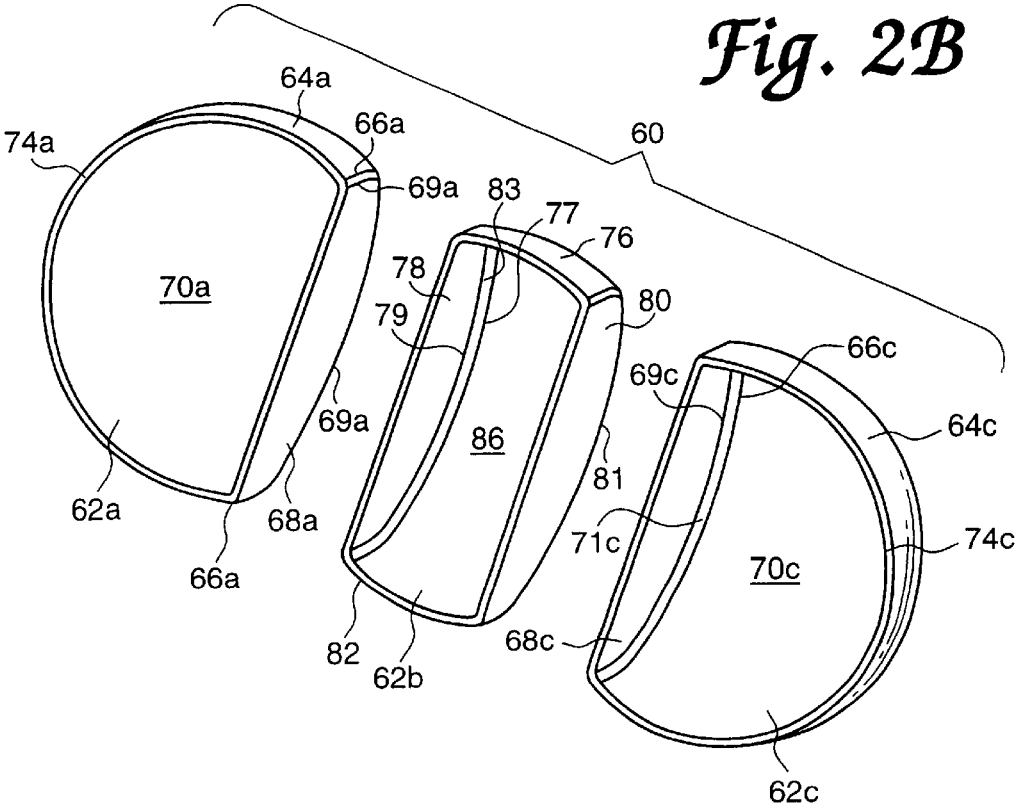

In the embodiment illustrated in FIGS. 2A and 2B, the set of closure modules 60 comprises two end closure modules 62*a* and 62*c* and a middle closure module 62*b*.

The end closure module 62*a* comprises an arcuate surface portion 64*a* and an interfacing portion, which in the illustrated embodiment is represented by a planar surface portion 68*a*. The arcuate surface portion 64*a* has an arcuate marginal extent 66*a* defining an arcuate edge. The planar surface portion 68*a* has an arcuate marginal extent 69*a* integrally connected with the marginal extent 68*a* of the arcuate surface portion 64*a* so that the marginal extent 68*a* of the planar surface portion 68*a* is contiguous with the arcuate marginal extent 66*a* of arcuate surface portion 64*a*. Likewise, end closure module 62*c* also comprises an arcuate surface portion 64*c*, and a planar surface portion 68*c* having a marginal extent 69*c* integrally connected with a marginal extent 66*c* of the arcuate surface portion 64*c* (along transition region 71*c*).

Collectively, the arcuate surface portion 64*a* and the planar surface portion 68*a* define a closure module chamber 70*a*. Defined at the periphery of the closure module chamber 70*a* by free edges 74*a* of the closure module arcuate surface portion 64*a* and the planar surface portion 68*a* is a closure module opening (unnumbered). Likewise, the end closure module 62*c* has a closure module chamber 70*c* collectively defined by the arcuate surface portion 64*c* and the planar surface portion 68*c*, and a closure module opening (unnumbered) defined at its periphery by free edges 74*c* of the closure module arcuate surface portion 64*c* and the planar surface portion 68*c*.

A middle closure module 62*b* is arranged between the end closure modules 62*a* and 62*c*. The middle closure module 62*b* comprises an arcuate surface portion 76 and first and second planar surface portions 78 and 80. The arcuate surface portion 76 has a pair of opposed free edges 82. The arcuate surface portion 76 also has arcuate marginal extents 77 positioned on opposite sides thereof integrally connected with marginal extents 79 and 81 of the first and second planar surface portions 78 and 80, respectively (with transition region 83 between marginal extents 77 and 79 being shown). In this manner, the first and second planar surface portions 78 and 80 respectively extend between opposite comers of the opposed free edges so that the planar surface portions 78 and 80 are parallel to and opposing each other.

Collectively, the arcuate surface portion 76 and the first and second planar surface portions 78 and 80 define a closure module chamber 86. Defined at the periphery of the closure module chamber 86 by free edges 82 of the arcuate surface portion 76 and the free edges of the first and second planar surface portion 78 and 80 is a closure module opening (unnumbered).

FIG. 2A depicts closure modules 62*a*, 62*b*, and 62*c* arranged to be coupled as a set to ends of respective associated cells. When arranged in a set, the planar surface portion 68*a* of the end closure module 62*a* is constructed and arranged to lie contiguously against and be coupled with the first planar surface portion 78 of the middle closure module 62*b*. Likewise, the planar surface portion 68*c* of the end closure module 62*c* is constructed and arranged to abut contiguously against to and be coupled with the second planar surface portion 80 of the middle closure modules 62*b*. The end closure modules 62*a* and 62*c* may be coupled respectively to opposite planar surface portions 78 and 80 of the middle closure module 62 by techniques known in the art, including welding, brazing, adhesive bonding, and/or other suitable fastening techniques. Additionally or as an alternative to direct coupling of the closure modules 62*a*, 62*b*, and 62*c*, the relative positioning of the closure modules 62*a*, 62*b*, and 62*c* can be maintained indirectly via coupling to their respective associated cells.

The closure modules 62*a*, 62*b*, and 62*c* can be connected to their associated cells by welding, brazing, fastening and/or other suitable coupling techniques. Preferably, an external weld is provided at position 79, i.e., at the interfacing surfaces of sets of the closure modules 62*a*, 62*b* and 62*b*, 62*c* to seal the closure modules together. Back-up rings or mounts can be used to facilitating welding, as would be within the purview of one of ordinary skill in the art. The free edges 74*a*, 74*c*, and 82 of the exposed arcuate surface portions 64*a*, 64*c*, and 76 of the closure modules are joined to the edges of the arcuate outer wall segments of their associated cells. However, the edges of the internal planar surface portions 68*a*, 68*c*, 78, and 80 of the closure modules can optionally be spaced from the edges of the internal web segments of their associated cells to provide clearances for maintaining the cells in fluid communication.

Figure 3A:
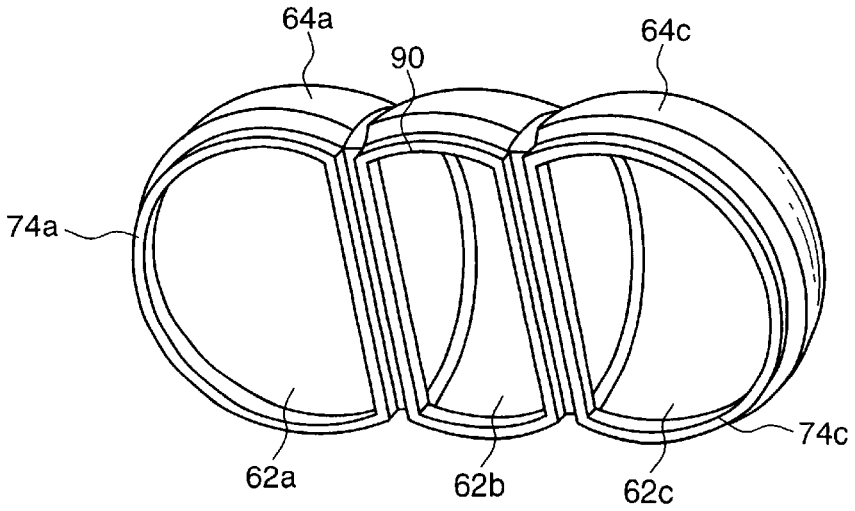
FIGS. 3A and 3B are a perspective view and a perspective exploded view, respectively, of a set of closure modules arranged in accordance with another embodiment of this invention.
Figure 3B:
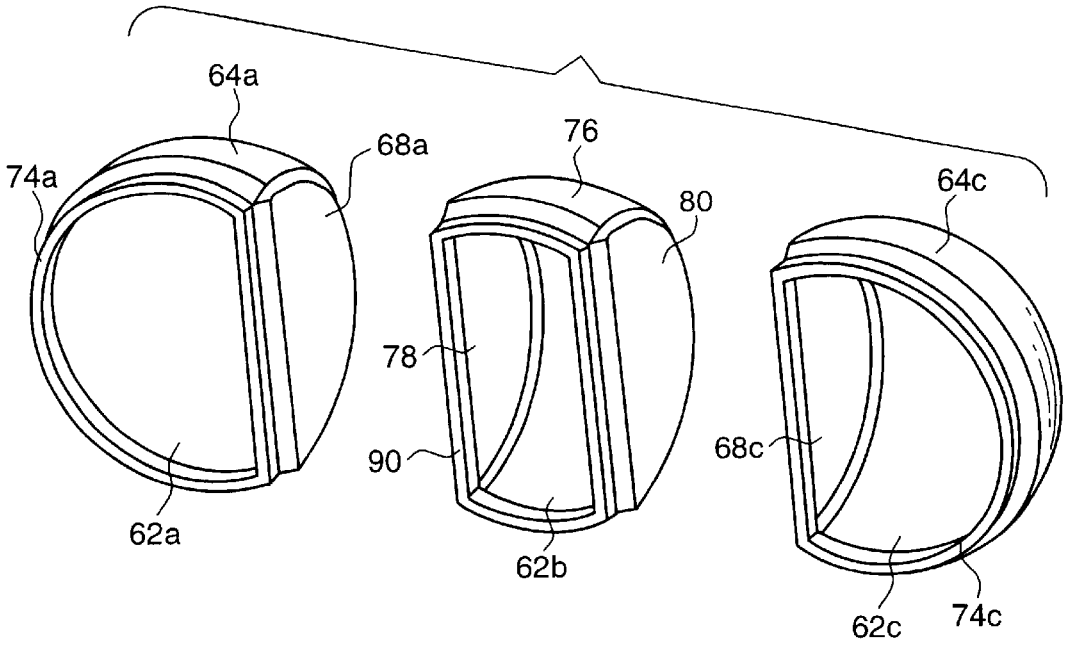

Another embodiment illustrated in FIGS. 3A and 3B, in which components similar in structure and function to components of the embodiment of FIGS. 2A and 2B are designated by like reference numerals. In this embodiment, formed about the closure module openings of end closure modules 62*a* and 62*c* are joggle 74*a* and joggle 74*c*, respectively. Each of the joggles is preferably an integral extension of both its corresponding closure module arcuate surface portion (64*a* or 64*c*) and planar surface portion (68*a* or 68*c*). The joggle 74*a* is internally flanged (relative to portions 64*a* and 68*a*) to permit the insertion and intimate fitting of the outer surface of the joggle 74*a* with the free end of an associated cell of the body portion (not shown in FIGS. 3A and 3B). In this manner, the end closure module 62*a* cooperates with the associated cell to close the end of the associated cell chamber to close the chamber. The joggle 74*c* of the end closure module 62*c* is constructed and arranged in a similar manner to cooperate with a free end of an associated cell of the body portion.

In this alternative embodiment, a joggle 90 is also formed about the closure module opening of the middle closure modules 62*b*. The joggle 90 is preferably an integral extension of the closure module arcuate surface portion 76 and the first and second planar surface portions 78 and 80. The joggle 90 is internally flanged relative to portions 76, 78, and 80 to permit the insertion and intimate contact of the outer surface of the joggle 90 to the free end of an associated cell of the body portion (not shown in FIGS. 3A and 3B). In this manner, the end closure module 62*b* cooperates with the associated cell to close the end of the associated cell chamber.

The joggles should be constructed to make allowances for joints connecting the internal and arcuate wall segments, such as joint 20. That is, during assembly the joggles preferably should not abut against the face of the joints 20 and thereby prevent coupling between the end closure modules and the body portion of the vessel. By way of example and without limitation, such allowances may be made by making the joggles discontinuous at portions corresponding to the joint 20, or by shaping the joggles to conform to the shape of the joint 20 or lie inside of the joint 20.

With reference to FIGS. 4–7, embodiments of multi-cell pressure vessel bodies will now be described. It should be understood, however, that the present invention is not limited to the illustrated embodiments. Other multi-cell pressure vessel bodies are suitable for use with the inventive module end closures.

The body portion of the pressure vessel preferably comprises a plurality of arcuate outer wall segments 116. The outer wall segments 116 are connected with internal web segments 118, thereby defining the various cells of the pressure vessel. Because the body portion of the pressure vessel is configured with a substantially uniform cross section, the segments 116 and 118, which comprise the body portion, may be formed, by way of example, by extrusion or can be rolled from sheet stock.

Adjacent outer wall segments 116 are attached to a corresponding internal web segment 118 by utilizing a joint 120. The joint 120 extends the entire length of the body portion 112 and has a substantially uniform cross section throughout along its length.

Because of its uniform cross section, the joint 120 is best described with reference to its cross section, as illustrated in greater detail in FIG. 4. The joint 120 includes a tab 122 configured at the end of each arcuate outer wall segment 116. The tabs 122 of adjacent end segments are preferably configured to be symmetrical to each other. Additionally, the adjacent tabs 122 are configured for contiguous engagement with each other, thereby forming a seam 124 along the exterior surface (unnumbered) of the pressure vessel.

A sealing weld 125 extends along the seam 124. In contrast to a weld utilized on conventional multi-cell pressure vessels, in which the weld must bear the entire load imposed upon the joint, the weld 125 utilized along the seam 124 serves primarily to seal the joint, although the weld 125 may provide some contribution to the bearing properties of the joint 120. For example, an electron beam welder can be utilized to make the weld 125. One of ordinary skill in the art will appreciate that other sealing methods may also be employed along the seam 124.

Figure 5:
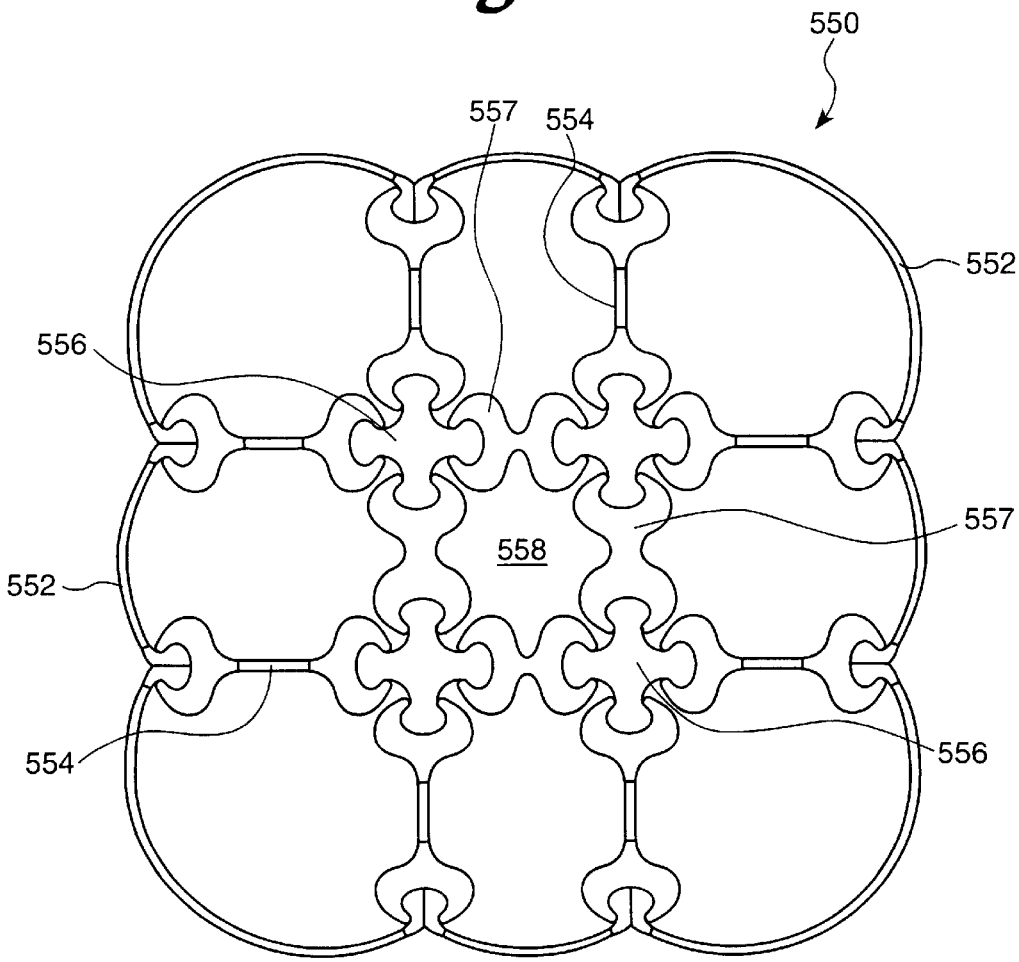
FIG. 5 is a cross-sectional view of the body portion of a pressure vessel utilizing the joint structure illustrated in FIG. 4.

Each of the tabs 122 is preferably configured with a straight, back portion 126 contiguous in engagement with the corresponding back portion 126 of the adjacent tab. With the tabs 122 positioned in contiguous engagement along their respective back portions 126, the tabs 122 collectively form a boss 128. The boss 128 is thus configured with a proximate neck portion 130 and a distal body portion 132. As illustrated in FIG. 5, the body portion 132 has a width greater than that of the neck portion 130. The boss 128 preferably has a perimeter configured in a curvilinear shape.

The joint 120 also includes a retaining member 140 configured at the end of the internal web segment 118. The retaining member 140 includes two lobes 142, which are preferably symmetrical to each other. The lobes 142 extend about the body portion 132 of the boss 128 and terminate at the neck portion 130 of the boss 128. The retaining member 140 is thus configured to capture the boss 128 with the lobes 142 of the retaining member 140 positioned substantially contiguous to the entire exterior contour of the boss 128.

Fabrication of the body portion 112 can be performed by extrusion of long wall segments, which are connected by the joint structure described above. The wall segments and joint components are preferably formed of aluminum and various aluminum alloys, such as 5083, 5086, 6061, or 6063, and may have various tempers, such as 6061-T6. One of skill in the art will appreciate that a variety of materials, such as steel and plastic, could be utilized in the extrusion of these segments, depending on the particular application for which the segments are to be used.

Figure 4:
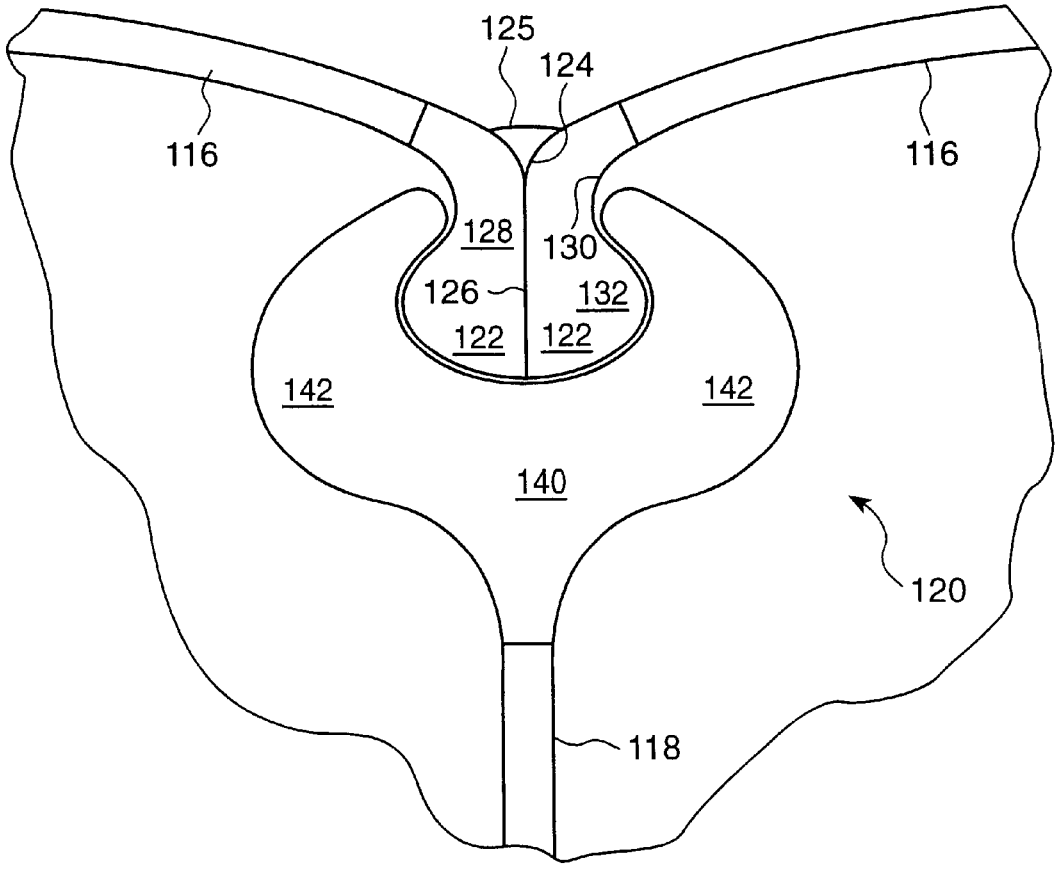
FIG. 4 is an enlarged cross-sectional view of the joint suitable for connecting arcuate outer wall segments and internal web segments of the pressure vessel body together.

Utilizing the embodiment of the joint in FIG. 4, a variety of shapes of pressure vessels may be formed through extrusion. For example, in FIG. 5, one such non-conventionally shaped pressure vessel 550 utilizing the joint is illustrated. The pressure vessel 550 includes a variety of shapes of exterior segments 552, various sizes of internal web segments 554, hub segments 556, and hub connecting segments 557. Pressure vessel 550 includes an internal cell 558 individually defined by a combination of internal web segments 554, but not any arcuate outer wall segments 552.

Figure 6:
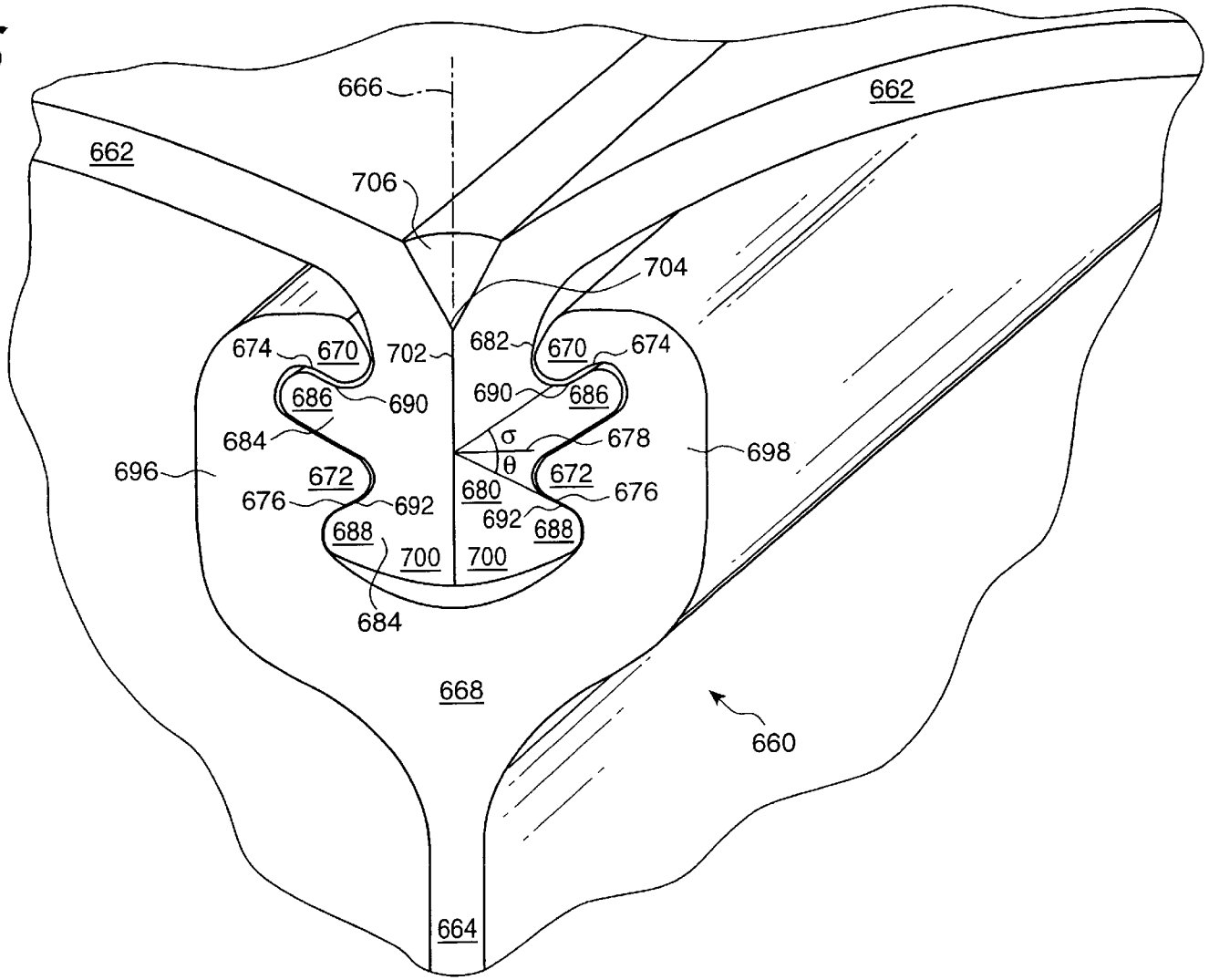
FIG. 6 is a cross-sectional view of a pressure vessel utilizing an alternative joint structure shown in FIG. 1.

Referring now to FIG. 6, another embodiment of a joint suitable for use with the present invention is illustrated. In FIG. 6, a double-acting joint 660 connecting two outer wall segments 662 and an inner web segment 664 is disclosed. It should be appreciated, however, that the double-acting joint 660 can be utilized to connect any of a variety of segments together. Thus, although illustrated as connecting two outer wall segments and an internal web segment, the joint 660 may also be used to connect a single outer wall segment to an internal web segment, to connect two outer wall segments to each other, or to connect two internal web segments to each other, as dictated by the configuration of the pressure vessel to be constructed.

The double-acting joint 660 is capable of bearing a tensile load applied to the segments along a load axis 666. The joint 660 includes a retaining member 668 configured at the end of the inner web segment 664. The retaining member 668 has a perimeter configured in a curvilinear shape and is configured with a first pair 670 and a second pair 672 of inwardly projecting lobes. Each of the lobes 672 is configured with a load bearing surface positioned at an angle relative to the load axis 666. Thus, each lobe of the first pair of lobes 670 includes a load bearing surface 674 and each lobe of the second pair of lobes 672 includes a load bearing surface 676.

The retaining member 668 is preferably configured to be symmetrical about the load axis 666. Also, the retaining member 668 is preferably configured such that the angle $\sigma$ of the load bearing surfaces 674 of the first pair of lobes 670 with respect to the normal 678 to the load axis 666 is equal and opposite to the angle $\theta$ of the load bearing surfaces 676 of the second pair of lobes 672 with respect to the normal 678 to the load axis 666.

It is preferred that the angles $\sigma$, $\theta$ be equal in magnitude and be between about 30 and 40 degrees, more preferably 30 degrees each.

The double-acting joint 660 also includes a boss 680 configured at the end of the segment (or segments) to which the retaining member 668 is to be secured. The boss 680 is preferably symmetrical about the load axis 666.

The boss 680 includes a proximate neck portion 682 and a distal body portion 684, with the body portion 684 having a width greater than that of the neck portion 682. The body portion 684 of the boss 680 is configured with a first pair 686 and a second pair 688 of outwardly projecting lips each having a load bearing surface. Thus, each of the first pair of lips 686 has a load bearing surface 690 and each of the second pair of lips 688 has a load bearing surface 692.

When assembled, the load bearing surfaces 690 of the first pair of lips 686 are in engagement with the respective load bearing surfaces 674 of the first pair of lobes 670 of the retaining member. The load bearing surfaces 692 of the second pair of lips 688 are in engagement with the respective load bearing surfaces 676 of the second pair of lobes 672 of the retaining member 168 when assembled. The first pair of lobes 670 of the retaining member 668 are positioned at a distal end of the segment to which they are attached and are configured to mate with the boss 680 at the neck portion 682 of the boss.

Hence, the retaining member 668 includes two arms 696 and 698 extending about the body portion 684 of the boss 680 and terminating at the neck portion 682 of the boss 680. The arms 696 and 698 of the retaining member 668 are preferably configured to be symmetrical to each other about the load axis 666 and are positioned in the joint to be substantially contiguous to the entire exterior contour of the boss 680.

As a load is applied to the segments 662 and 666 to place the joint 660 in tension, the forces will act upon load bearing surfaces 676 and 692 in a direction normal to the surfaces, thereby tending to force lobes 672 to spread outwardly. Simultaneously, however, the forces acting upon load bearing surfaces 674 and 690 tend to force the first pair of lobes 670 in the opposite direction, thereby assisting in counteracting the spreading force being applied on the lobes 672. Thus, it is presently preferred that the load bearing surfaces 674 of the first pair of lobes 670 extend inwardly towards the segment in which they are configured, thereby providing a load bearing surface which counteracts the load being applied at the load bearing surface 676 of the second pair of lobes 672.

The double-acting joint 680 may be successfully utilized to connect together three segments, such as two outer wall segments and an inner web segment. In FIG. 6, the boss 680 comprises two symmetrically shaped tabs 700 positioned in contiguous engagement—one of the tabs 700 configured at the end of one of the outer wall segments 662 and the other of the tabs 700 configured at the end of the other outer wall segment. The tabs 700 each have a straight, back portion 702 in contiguous engagement with the corresponding back portion of the adjacent tab.

The contiguous tabs 700 form an exposed seam 704 along the exterior of the outer wall segments 662. A sealing weld 706, such as that formed by an electron beam welder or other suitable welding technique, is preferably utilized for attaching the contiguous tabs 700 at the exposed seam 704.

Figure 7:
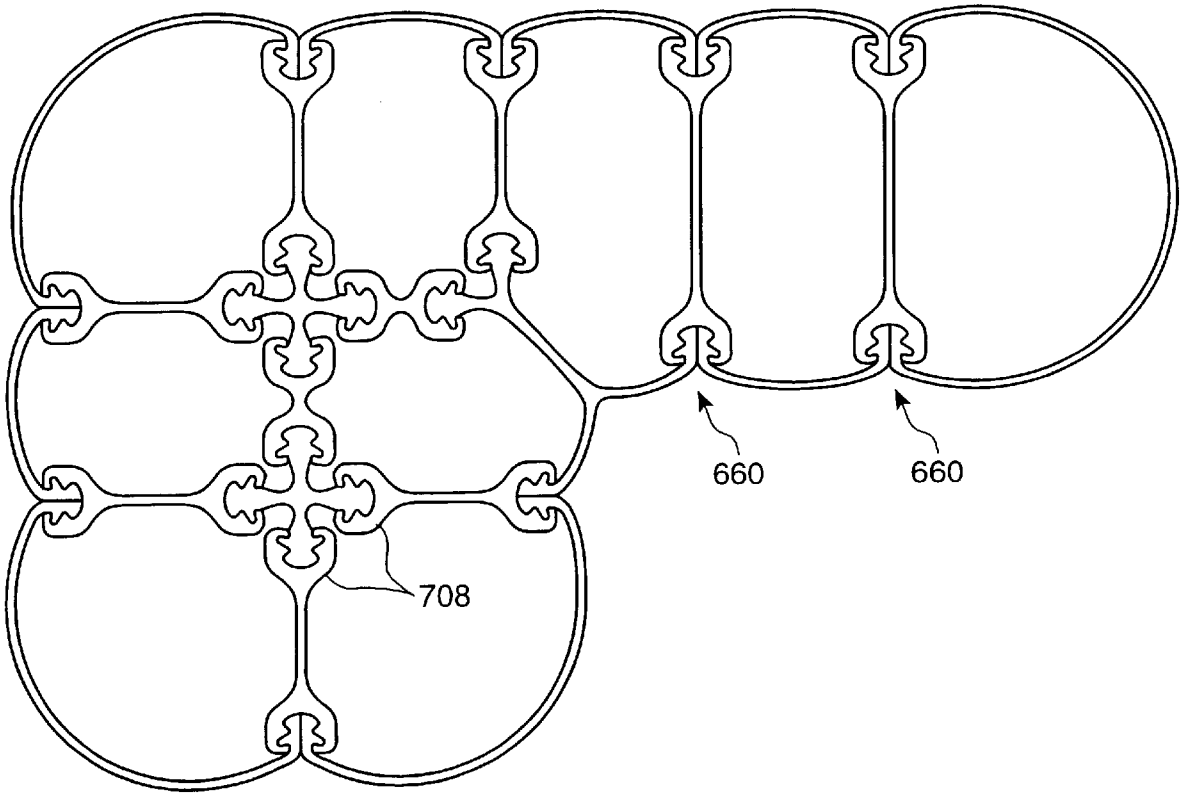
FIG. 7 is a cross-sectional view of the body portion of a pressure vessel utilizing the joint structure illustrated in FIG. 6.
Figure 8:
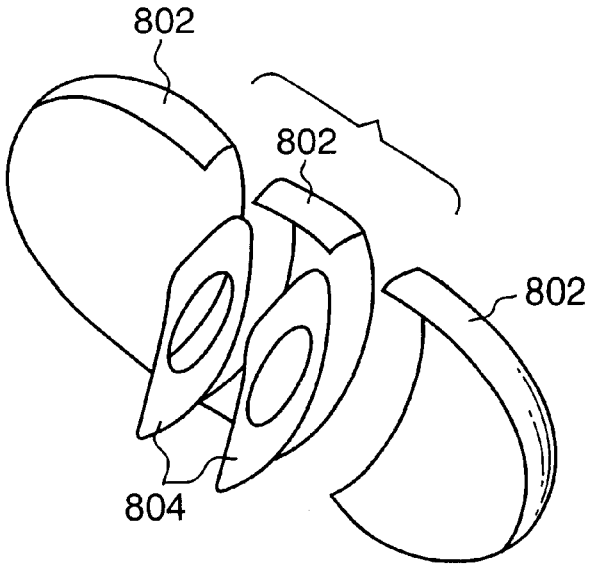
Fig. 8 (PRIOR ART)
FIG. 8 is an exploded perspective view of an earlier end closure module.
Figure 9:
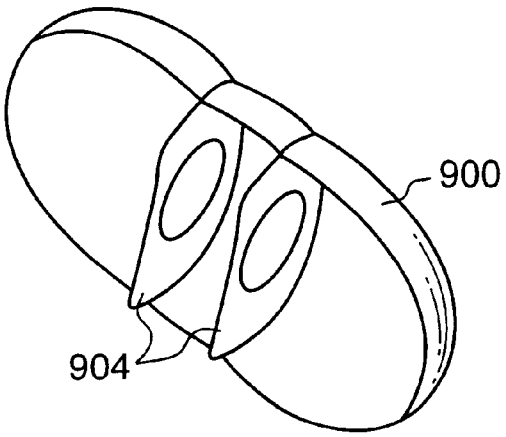
Fig. 9 (PRIOR ART)
FIG. 9 is a perspective view of another example of an earlier end closure module.

As illustrated in FIG. 7, the double-acting joint 660 may be utilized in the assembly of extruded pressure vessels having a variety of cross-sectional configurations. If the joint 660 is utilized to connect two internal segments together, as illustrated at 708, rather than the three segments illustrated in FIG. 6, no sealing weld is necessary.

Retrofitting can be accomplished by fitting and mounting the inventive pressure vessel within the space previously occupied by the gasoline tank. In addition, the pressure vessel may be configured with fixtures defining exterior recesses capable of engaging conventional gasoline tank straps. Thus, the same tank straps previously used to secure the gasoline tank to the vehicle can be used, without substantial alteration or further testing, to secure the pressure vessel to the vehicle.

Those of skill in the art will appreciate that the pressure vessel and end closures of the present invention are not limited to use in retrofitting vehicles. The present invention also has applications in the design of new vehicles, as well in other applications which benefit from the use of pressure vessels having a substantially rectangular shape.

Various modifications and variations to the illustrated embodiment fall within the scope of this invention and the appended claims. For example, although the interfacing surface portions are represented by planar surface portions in the drawings, it is understood that the interfacing surface portions can have curved or linear contours, so long as an interfacing surface portion is constructed and arranged to abut contiguously against and facilitating coupling with the interfacing surface portion of an adjacent closure module. Likewise, although the modules are depicted with dome-like configurations, it is understood that the modules may possess other configurations, including symmetrical and asymmetrical polygonal patterns, so long as at least some of the modules have an arcuate surface portion for mating with the arcuate outer wall segments 16 of the vessel body 12 and at least one interfacing surface portion as described above.

Additionally, valves, such as 15 in FIG. 1, capable of selectively providing fluid communication between an interior chamber of the pressure vessel and an exterior pressurized fluid line can be provided to control the flow of fluid into and out of the pressure vessel. A pressure release mechanism for bleeding off pressurized fluid can also be provided in the event that the internal pressure exceeds a predetermined value. The valve may also include a fusible plug to provide emergency venting in the presence of high temperatures.

Modifications to the internally flanged joggles also fall within the scope of this invention. For example, the internally flanged joggles may extend over only a portion of its associated closure module opening so that the joggle contacts only a portion of edge defining its associated cell chamber opening. Moreover, the internally flanged joggles do not have to be integrally formed with its associated arcuate and planar surface portions; rather, the joggle may be connected to already formed arcuate and planar surface portions, although this alternative embodiment would have a deleterious affect on processability.

The foregoing embodiments described in the detailed description of the invention were chosen and described in order to best explain the principles of the invention and its practical application, thereby enabling others skilled in the art to understand the invention for various embodiments and with various modifications as are suited to the particular use contemplated. Modifications and equivalents will be apparent to those practitioners skilled in the art, and are included within the spirit and scope of the appended claims.

What is claimed is:

1. A set of closure modules for constructing therewith an end closure structure for a multi-cell pressure vessel which comprises a body portion comprising a plurality of arcuate outer wall segments connected by internal web segments so that the arcuate outer wall and internal web segments collectively define cells having opposite ends, said set of closure modules comprising:

a first closure module comprising an arcuate surface portion and an interfacing surface portion, the interfacing surface portion having a marginal extent integrally connected with a marginal extent of said arcuate surface portion, said arcuate surface portion and said interfacing surface portion defining, collectively or in combination with at least one additional interfacing surface portion, a closure module chamber with a closure module opening, said closure module opening being defined at a periphery thereof by either free edges of said arcuate surface portion and said interfacing surface portion or free edges of said arcuate surface portion, said interfacing surface portion, and said at least one additional interfacing surface portion; and a second closure module adjacent the first closure module, the second closure module comprising an arcuate surface portion and an interfacing surface portion, the interfacing surface portion having a marginal extent integrally connected with a marginal extent of said arcuate surface portion, said arcuate surface portion and said interfacing surface portion defining, collectively or in combination with at least one additional interfacing surface portion, a closure module chamber with a closure module opening, said closure module opening being defined at a periphery thereof by either free edges of said arcuate surface portion and said interfacing surface portion or free edges of said arcuate surface portion, said interfacing surface portion, and said at least one additional interfacing surface portion, wherein said interfacing surface portion of said first closure module abuts contiguously against said interfacing surface portion of said second closure module.

2. The set of closure modules of claim 1, wherein said interfacing surface portion of said first closure module and said interfacing surface portion of said second closure module are planar and coupled to each other by coupling the first and second closure modules to the ends of associated ones of the cells.

3. The set of closure modules of claim 1, wherein said interfacing surface portion of said first closure module and said interfacing surface portion of said second closure module are planar and coupled to each other independently of the cells.

4. The set of closure modules of claim 1, wherein said first closure module includes an internally flanged joggle formed about at least a portion of said closure module opening of said first closure module.

5. The set of closure modules of claim 4, wherein said joggle extends continuously around said closure module opening of said first closure module.

6. The set of closure modules of claim 4, wherein a portion said joggle forms an arcuate shape.

7. The set of closure modules of claim 1, wherein said arcuate surface portion of said first closure module is dome shaped.

8. The set of closure modules of claim 1, wherein:

the body portion comprises at least one internal cell defined at a periphery thereof by edges of a plurality of the internal web segments;

said set of closure modules further comprises an internal closure module comprising an arcuate surface portion and a plurality of interfacing surface portions; and said interfacing surface portions of said internal closure module have respective edges that collectively define a closure module opening for closing an end of the internal cell.

9. The set of closure modules of claim 1, wherein said first closure module of said set of closure modules is an end closure module.

10. The set of closure modules of claim 1, wherein said first closure module of said set of closure modules is a middle closure module.

11. The set of closure modules of claim 10, wherein said second closure module of said set of closure modules is an end closure module.

12. A multi-cell pressure vessel comprising:

a body portion comprising a plurality of arcuate outer wall segments connected by internal web segments that collectively define a plurality of cells and terminate at ends thereof to define peripheries of cell chamber openings; and a set of closure modules comprising:

a first closure module comprising an arcuate surface portion and an interfacing surface portion, the interfacing surface portion having a marginal extent integrally connected with a marginal extent of said arcuate surface portion, said arcuate surface portion and said interfacing surface portion defining, collectively or in combination with at least one additional interfacing surface portion, a closure module chamber with a closure module opening, said closure module opening being defined at a periphery thereof by either free edges of said arcuate surface portion and said interfacing surface portion or free edges of said arcuate surface portion, said interfacing surface portion, and said at least one additional interfacing surface portion; and a second closure module adjacent the first closure module, the second closure module comprising an arcuate surface portion and an interfacing surface portion, the interfacing surface portion having a marginal extent integrally connected with a marginal extent of said arcuate surface portion, said arcuate surface portion and said interfacing surface portion defining, collectively or in combination with at least one additional interfacing surface portion, a closure module chamber with a closure module opening, said closure module opening being defined at a periphery thereof by either free edges of said arcuate surface portion and said interfacing surface portion or free edges of said arcuate surface portion, said interfacing surface portion, and said at least one additional interfacing surface portion, wherein said interfacing surface portion of said first closure module abuts contiguously against and is coupled with said interfacing surface portion of said second closure module, and wherein each closure module of said set of closure modules closes an associated end of a respective one of said cells at a respective one of said cell chamber openings.

13. The multi-cell pressure vessel of claim 12, wherein said interfacing surface portion of said first closure module and said interfacing surface portion of said second closure module are planar and abut against each other.

14. The multi-cell pressure vessel of claim 12, wherein said interfacing surface portion of said first closure module and said interfacing surface portion of said second closure module are planar and connected to each other independently of said cells.

15. The multi-cell pressure vessel of claim 12, wherein said first closure module includes an internally flanged joggle that is formed about at least a portion of said first closure module opening and is inserted into, coupled to, and closes one of said cell chamber openings of an associated one of said cells.

16. The multi-cell pressure vessel of claim 15, wherein said joggle extends continuously around said closure module opening of said first closure module.

17. The multi-cell pressure vessel of claim 16, wherein said joggle is inserted into and coupled to one of said cell chamber openings of an associated one of said cells to continuously contact said joggle against an inner periphery of said associated one of said cells.

18. The multi-cell pressure vessel of claim 15, wherein a portion said joggle forms an arcuate shape which continuously contacts at least one of said arcuate outer wall segments.

19. The multi-cell pressure vessel of claim 12, wherein said arcuate surface portion of said first closure module is dome shaped.

20. The multi-cell pressure vessel of claim 12, wherein:

said body portion comprises at least one internal cell defined at a periphery thereof by edges of a plurality of said internal web segments;

said set of closure modules further comprises an internal closure module comprising an arcuate surface portion and a plurality of interfacing surface portions; and said interfacing surface portions of said internal closure module have respective edges that collectively define a closure module opening and close an end of the internal cell.

21. The multi-cell pressure vessel of claim 12, wherein said first closure module of said set of closure modules is an end closure module.

22. The multi-cell pressure vessel of claim 12, wherein said first closure module of said set of closure modules is a middle closure module.

23. The multi-cell pressure vessel of claim 22, wherein said second closure module of said set of closure modules is an end closure module.

24. A vehicle comprising the multi-cell pressure vessel of claim 12.

25. A multi-cell pressure vessel comprising:

a body portion comprising a plurality of arcuate outer wall segments connected by internal web segments that collectively define a plurality of cells and terminate at ends thereof to define peripheries of cell chamber openings; and a set of closure modules comprising:

a first closure module comprising an arcuate surface portion having an inner surface and an interfacing surface portion having a planar inner surface, a planar outer surface opposite to the planar inner surface, and a marginal extent, the marginal extent of the interfacing surface portion being integrally connected with a marginal extent of said arcuate surface portion, said inner surface of said arcuate surface portion and said planar inner surface of said interfacing surface portion defining, collectively or in combination with at least one additional interfacing surface portion, a closure module chamber with a closure module opening, said closure module opening being defined at a periphery thereof by either free edges of said arcuate surface portion and said interfacing surface portion or free edges of said arcuate surface portion, said interfacing surface portion, and said at least one additional interfacing surface portion; and a second closure module comprising an arcuate surface portion having an inner surface and an interfacing surface portion having a planar inner surface, a planar outer surface opposite to the planar inner surface, and a marginal extent, the marginal extent of the interfacing surface portion being integrally connected with a marginal extent of said arcuate surface portion, said inner surface of said arcuate surface portion and said planar inner surface of said interfacing surface portion defining, collectively or in combination with at least one additional interfacing surface portion, a closure module chamber with a closure module opening, said closure module opening being defined at a periphery thereof by either free edges of said arcuate surface portion and said planar surface portion or free edges of said arcuate surface portion, said interfacing surface portion, and said at least one additional interfacing surface portion, wherein said planar outer surface of said interfacing surface portion of said first closure module abuts contiguously against and is coupled with said planar outer surface of said interfacing surface portion of said second closure module, and wherein each closure module of said set of closure modules closes an associated end of a respective one of said cells at a respective one of said cell chamber openings.

26. The multi-cell pressure vessel of claim 25, said interfacing surface portions of said first and second closure modules are oriented parallel to said internal web segments.

* * * * *